United States Patent [19]

Feder

[11] 4,396,124

[45] Aug. 2, 1983

[54] HANGER BAR

[76] Inventor: Harold Feder, P.O. Box 1019, Lower Hook Rd., Bayonne, N.J. 07002

[21] Appl. No.: 316,409

[22] Filed: Oct. 29, 1981

[51] Int. Cl.[3] ..... A47F 7/19

[52] U.S. Cl. ..... 211/124; 206/290; 211/7

[58] Field of Search ..... 211/124, 123, 7, 105.1; 248/264, 262, 251; 206/289, 290, 291

[56] References Cited

U.S. PATENT DOCUMENTS

| | | | |
|---|---|---|---|
| 2,357,309 | 9/1944 | Brown et al. | 211/124 |
| 3,021,958 | 2/1962 | Winkler | 211/124 |
| 3,162,314 | 12/1964 | Belsinger | 206/291 X |
| 3,349,923 | 10/1967 | Feder | 211/123 |
| 3,610,427 | 10/1971 | Maziarka et al. | 211/123 |
| 3,633,760 | 1/1972 | Vosbikian | 211/124 |
| 4,293,076 | 10/1981 | Collin | 211/124 |

*Primary Examiner*—Ramon S. Britts
*Assistant Examiner*—Robert W. Gibson, Jr.
*Attorney, Agent, or Firm*—Stephen E. Feldman; Marvin Feldman; Jules L. Chaboty

[57] ABSTRACT

A wardrobe carton hanger bar structure, for mounting a plurality of garment hangers seriatim and in registration in a wardrobe carton, so that the hangers and associated garments mounted on the hangers are suspended from the main bar of the hanger bar structure, and so that the hangers are restrained from being dislodged from the hanger bar structure. The present article of manufacture features an auxiliary bar adjacent the main bar. The auxiliary bar is disposed laterally to the side of and parallel to the main bar and in registration, so that the auxiliary bar restrains hangers mounted on the main bar against being dislodged. End brackets are provided to receive the respective ends of the main bar and auxiliary bar. Each end bracket is provided with two spaced apart terminal transverse flanges in registration, so that the hanger bar structure may be fitted onto the upper edges of two opposed walls of the wardrobe carton.

21 Claims, 7 Drawing Figures

HANGER BAR

BACKGROUND OF THE INVENTION

1. Field of the Invention

A hanger bar for hanging a plurality of garments each mounted on one of a plurality of individual and discrete hangers in a wardrobe carton, so that the garments may be shipped in the carton to a destination without being dislodged or falling to the bottom of the carton in a heap.

2. Description of the Prior Art

In the shipping of garments or articles of clothing, especially from manufacturer to warehouse or from warehouse to retail outlet, it was the practice a number of years ago to ship the clothing by folding the garments and placing them layer upon layer in a container. Since most garments or articles of clothing are normally supported upon hangers when made or stored, this procedure involved the necessity of removing each garment from its respective hanger, and manually folding the same; and doing the same operations in reverse order at the end of the trip to which the garments have been subjected. In view of the fact that the garments are folded and laid upon each other, it is frequently necessary in such a packaging procedure to pad or separate the various garments by means of tissue paper, ect., in an effort to prevent unsightly creases. Furthermore, in as much as the garments packed at the lowest portions of the container support the weight of all of the garments thereabove, undesirable creasing and wrinkling must necessarily occur and this condition is aggravated by hot or humid conditions of travel. On the receiving end, considerable manual effort, time and bother were required in order to place the garments into saleable condition. The garments had to be removed from the container, usually one by one, and then sponged and/or steam pressed, and placed upon hangers.

All of these costly and unnecessary steps were obviated with the development of hanger bars of various configurations, by means of which a plurality of garment hangers and associated mounted garments could be suspended from the hanger bar structure and within the wardrobe carton, with the plurality of garment hangers being mounted seriatim and in registration on the hanger bar, and the hanger bar in turn, being mounted on and between two opposed upper edges of the wardrobe carton or container. Thus, it was now only necessary to take the garments already on hangers and to hang up these hangers within a new container. The "hanging-up" operation is so simple, that a plurality of hangers having garments thereon may be "hung up" at one time, prior to the beginning of the trip or other shipping. During transit, each garment is supported upon an individual hanger, and no garment supports the weight of any of the others. At the end of the trip, it is merely and only necessary to open the container and remove the garments still on the hangers, and transfer them to racks located in the warehouse or retail outlet. Thus in summary, in the garment industry, shipping cases, containers or cartons are provided for shipping garments that are in turn, supported on conventional garment hangers. A hanger bar is provided for suspending the garment hangers, and this bar is mounted at the top of the shipping carton or container, and extends between opposed walls of the carton or container. Typically, the hanger bar is mounted on the top of the side walls of the casing or container on brackets, generally of U-shaped configuration, which are placed over the tops of the opposite vertical side walls. The garment hanger and hanger bar are generally disposable items supplied to the garment manufacturer, since any rust on the hanger or hanger bar could cause damage to clothes, if the hangers were repeatedly used. For this reason, hanger bars and clothes hangers are extremely high-volume items. Nevertheless, to date, these items have been comparatively expensive to manufacture. This is especially true of the hanger bar, because of the multiplicity of sheet-metal-forming steps to construct a bracket of sufficient strength and durability to maintain the garments in the proper position during the sometimes rugged movement encountered during shipment. These hangers have generally taken the form of U-shaped end brackets which fit over the upper ends of the sides of the garment carton, with the hanger bar suspended on the brackets and extending across the interior of the carton to provide a support for the clothes hangers at the upper end of the carton or casing. The various manners of attaching the bar to the brackets to provide a rugged interconnection has in the past contributed greatly to the cost of these items.

One of the problems encountered when shipping garments in wardrobe cartons and on individual hangers mounted on a hanger bar is that displacement, rough handling, transfer, impact, vibration, dropping, inversion, tilting, etc. of the carton can result in the dislodging of the hangers from the hanger bar, so that at the end of the shipping trip the garments and associated hangers are to be found lying in a pile or heap on the floor or bottom of the wardrobe carton, thus defeating the purposes of the hanger bar. One solution to this problem is discloses in U.S. Pat. No. 3,306,465, which teaches an improved wardrobe hanger bar construction, whereby the hanger bar includes an upper locking cap which may be quickly and readily assembled with the main body portion of the hanger bar, so that wire coat hangers carried thereon may be locked against inadvertent movement or displacement, and against disengagement of the wire hangers from the hanger bar by such movement.

Among the other recent prior art relative to hanger bars and the like may be mentioned, U.S. Pat. Nos. 4,139,102; 4,034,866; 3,902,597; 3,800,960; 3,773,184; 3,743,106; 3,633,760; 3,613,898; 3,610,427; 3,610,423; 3,519,139; 3,480,153; 3,403,787 and 3,380,596.

OBJECTS OF THE INVENTION

It is an object of the present invention to provide an improved and novel hanger bar structure for mounting a plurality of garment hangers seriatim and in registration in a wardrobe carton, container, box or case.

Another object is to provide an improved hanger bar structure for suspending a plurality of hangers and associated garments mounted on the hangers in a wardrobe carton or container employed to ship the garments.

A further object is to provide an improved hanger bar structure in which the hangers mounted on the hanger bar are restrained from being dislodged from the hanger bar structure.

An additional object is to provide a hanger bar structure which permits the shipping of garments mounted on hangers within a wardrobe carton without the garments being dislodged or falling to the bottom of the carton in a heap or pile.

Still another object is to prevent damage, creasing or folding of garments when shipped in a wardrobe carton or container or the like which is subject to rough handling, displacement, transfer, impact, vibration, dropping, inversion, tilting, etc., during transportation, shipping, loading, unloading or other motion of the wardrobe carton or container.

Still a further object is to provide a hanger bar structure which may be quickly and readily assembled.

Still an additional object is to provide a hanger bar structure in which garment hangers mounted thereto or thereon, and carried by the hanger bar, may be locked against inadvertent movement or displacement, and against disengagement of the hangers form the hanger bar by such movement.

Yet another object is to provide a new and improved hanger bar construction, including lateral locking means, whereby clothes or garment hangers may be securely locked against disengagement and against deformation during movement of the wardrobe carton or container or the like in which the hanger bar structure is mounted.

Yet a further object is to provide a hanger bar structure with a hanger locking device which is reliable and yet is easily operated.

Yet an additional object is to provide a combination hanger bar structure with lateral locking means which is of economical construction, and which is readily assembled from inexpensive parts and materials in mass production facilities using unskilled labor.

An object is to provide a hanger bar structure with novel and improved terminal brackets construction.

These and other objects and advantages of the present invention will become evident from the description which follows:

BRIEF DESCRIPTION OF THE INVENTION

The present invention basically entails the provision of an improved hanger bar structure for a wardrobe carton or container. The present hanger bar is for mounting a plurality of garment hangers seriatim and in registration in a wardrobe carton, so that the hangers and associated garments mounted on the hangers are suspended from the main bar of the hanger bar structure, and so that the hangers are restrained from being dislodged from the hanger bar structure. The present article of manufacture features an auxiliary bar adjacent the main bar. The auxiliary bar is disposed laterally to the side of and parallel to the main bar and in registration, so that the auxiliary bar restrains hangers mounted on the main bar against being dislodged. End brackets are provided to receive the respective ends of the main bar and auxiliary bar. Each end bracket is provided with two spaced apart terminal transverse flanges in registration, so that the hanger bar structure may be fitted onto the upper edges of two opposed walls of the wardrobe carton or container.

The hanger bar of the present invention is basically characterized by the provision of a hanger bar structure for mounting a plurality of garment hangers seriatim and in registration in a wardrobe carton, so that the hangers and associated garments mounted on the hangers are suspended from the hanger bar structure, an so that the hangers are restrained from being dislodged from the hanger bar structure. The present hanger bar structure thus basically includes a generally rectilinear main bar having two opposed ends, the hangers being mountable on the main bar, and at least one generally rectilinear auxiliary bar having two opposed ends. The auxiliary bar extends parallel to and laterally spaced from the main bar and in registration with the main bar, so that the auxiliary bar restrains hangers mounted on the main bar against being dislodged.

Two opposed end brackets are also provided; these brackets are spaced apart, one at each end of the main and auxiliary bars, and facing each other in mirror image fashion. Thus, a first bracket is provided; one end of the main bar and one end of the auxiliary bar are received in mounting means of the first bracket. Also, a second bracket is provided; the other end of the main bar and the other end of the auxiliary bar are received in mounting means of the second bracket. The mounting means of the first and second brackets for receiving and mounting the auxiliary bar are disposed laterally to the respective mounting means for the main bar, so that the auxiliary bar is mounted to the side of the main bar. Typically, each of the first and second brackets is also provided with two spaced apart terminal transverse flanges in registration, so that the hanger bar structure may be fitted onto the upper edges of two opposed walls of the wardrobe carton or container.

In a preferred embodiment, each upper wall edge of the wardrobe carton is provided with a notch, and each bracket has an upper bridge which connects together the two transverse flanges, and a web or panel dependent from the bridge and extending between the flanges, with the web or panel fitting into the notch. It is preferred in this version of the invention that the base of the notch should be curved, and the terminus of the web or panel should also be curved to amply and accurately fit into the notch and thus to prevent dislodging of the entire hanger bar structure from the wardrobe carton during shipping. In addition, in most instances the web or panel will terminate short of the lower edges of the flanges, these lower edges being opposite to the upper bridge.

Typically, the inner surface of at least one transverse flange will be provided with at least one stiffening rib. In most instances, this inner surface will be provided with a plurality of parallel and spaced apart stiffening ribs; generally, these stiffening ribs will extend perpendicular to the edge of a wall of the wardrobe carton; i.e., dependent from and perpendicular to the junction between the aforementioned upper bridge and the flange.

In most instances, each end of the main bar fits into a socket in the respective bracket, and the respective associated end of the auxiliary bar fits into a lateral flanged pocket or slot adjacent the socket. This flanged pocket or slot will usually be provided with at least one protruding ear on at least one flange, so that the end of the auxiliary bar may be snap-fitted into position. Typically, the ear is disposed on the flange adjacent the mouth of the pocket or slot.

As will appear infra, it is preferred that two generally rectilinear auxiliary bars be provided. The two auxiliary bars will be disposed laterally on opposite sides of the main bar, so that the two auxiliary bars straddle the main bar in registration. Typically, the main bar is generally rectangular in cross-section, and the auxiliary bar is generally flat, in the nature of a rectilinear strip. In this embodiment of the invention, typically, one flat side of the auxiliary bar faces the main bar. Usually, the bars will be composed of wood, and the brackets will be composed of a flexible resilient plastic, e.g., nylon, teflon, polyvinyl chloride, polyethylene or polypropylene, especially isotactic polypropylene.

The invention accordingly consists in the features of construction, combination of elements and arrangement of parts which will be exemplified in the article of manufacture hereinafter described, and of which the scope of application is as elucidated supra and as will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 4:
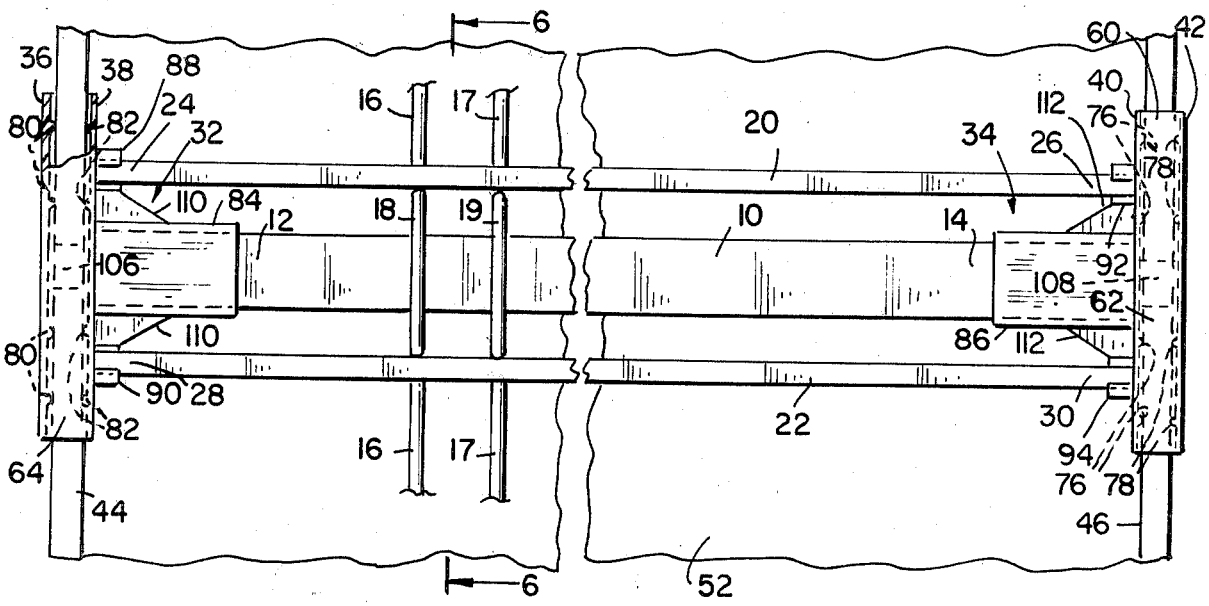
FIG. 4 is an overall plan view of the assembled hanger bar together with associated wardrobe carton and two mounted hangers.
Figure 5:
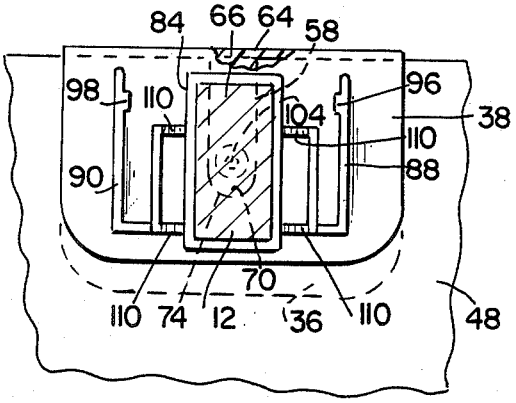
FIG. 5 is a sectional elevation view taken substantially along the line 5—5 of FIG. 1.
Figure 6:
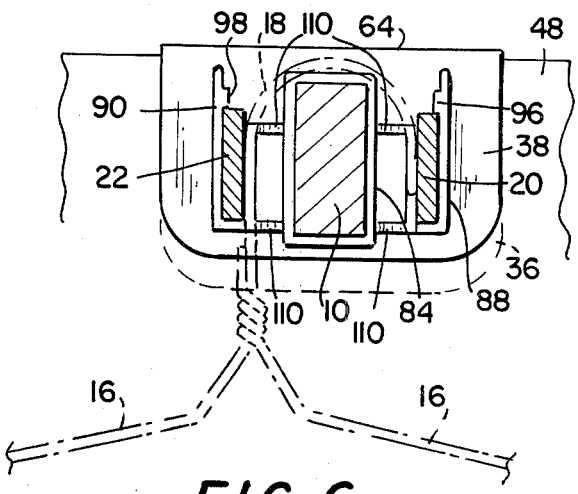
FIG. 6 is a sectional elevation view taken substantially along the line 6—6 of FIG. 4.

Referring now to the drawings, the present hanger bar structure is a configuration characterized by the provision of a generally rectilinear main bar 10 of generally rectangular cross-section, as best seen in FIGS. 5 and 6, and having two opposed ends 12 and 14. Garment hangers such as hanger 16 are mountable upon and mounted on the main bar 10, by means of an upper central hook portion such as 18 which, as shown, extends over the upper edge or face of the main bar 10. Another garment hanger 17 with upper central hook 19 also extending over main bar 10 is also shown, see FIG. 4. Garments or articles of clothing, not shown, are mounted on or draped over the hangers. This arrangement is commonly understood by those skilled in the art, and is further explained supra, especially in the cited prior art patents.

In this preferred embodiment of the invention and as shown in the drawings, two generally rectilinear auxiliary bars 20, 22 are provided. The auxiliary bars 20, 22 are disposed laterally on opposite sides of the main bar 10, and extend parallel to and laterally spaced from the main bar 10 in registration, so that the auxiliary bars 20, 22 restrain hangers such as 16 mounted on the main bar 10 against being dislodged, see especially FIG. 6, and with the two auxiliary bars 20, 22 straddling the main bar is registration, as best seen in FIGS. 4 and 6. Each auxiliary bar 20 or 22 is preferably flat, in the nature of a flat rectilinear strip, with one flat side of each auxiliary bar 20 or 22 facing the main bar 10. The bars 10, 20 and 22 are preferably composed of wood, however, these bars may alternatively be composed of metal or plastic, and the bars especially the main bar 10 may be hollow in practice. The auxiliary bar 20 has two opposed ends 24, 26, and the other auxiliary bar 22 has two opposed ends 28, 30.

A first bracket or fitting generally designated as 32 and a second bracket or fitting 34 are provided. The second bracket 34 is opposed to and a mirror image copy of the first bracket 32, and the brackets 32, 34 are disposed at the respective opposite ends 12, 14 of the main bar 10, as shown. Thus, the end 12 of the main bar 10, the end 24 of the auxiliary bar 20, and the end 28 of the auxiliary bar 22 are each receivable in and mounted into a mounting means of the first bracket 32; these mounting means being preferably of a specific configuration as will appear infra. Likewise, the end 14 of the main bar 10, the end 26 of the auxiliary bar 20, and the end 30 of the auxiliary bar 22 are each receivable in and mounted into a mounting means of the second bracket 34, these mounting means of the second bracket 34 being preferably of a specific configuration comparable to that of the first bracket 32, as will appear infra. In any case, the mounting means of the first and second brackets 32, 34 for mounting the auxiliary bars 20, 22 are disposed laterally to the respective central mounting means for the main bar 10, so that each auxiliary bar 20 or 22 is mounted to one side of the main bar 10, with the auxiliary bars 20, 22 straddling the main bar 10 as mentioned supra.

Typically, the brackets 32, 34 will in general, each be provided with two spaced apart terminal transverse flanges in registration, i.e., bracket 32 is provided with flanges 36 and 38 and bracket 34 is provided with flanges 40 and 42, so that the entire hanger bar structure may be mounted on and fitted onto the respective upper edges 44 and 46 of two opposed walls 48, 50 of the wardrobe carton generally designated as 52. The brackets 32, 34 will preferably be composed of a flexible resilient plastic such as one of the plastics mentioned supra, however, the brackets may alternatively be composed of wood, e.g., plywood, or sheet metal or metal castings, or the like.

Thus, in summary, the present hanger bar structure for mounting a plurality of garment hangers 16, 17 seriatim and in registration in a wardrobe carton 52, accomplishes the result that the hangers 16, 17 and associated garments, not shown, mounted to and on the hangers 16, 17 are suspended from the hanger bar structure, with the hangers 16, 17 being restrained from being dislodged from the main bar 10 of the hanger bar structure by the auxiliary bars 20, 22, see especially FIG. 6.

Details and appurtenances of the illustrated embodiment of the present hanger bar configuration will now be described. Referring first to the mounting of the terminal brackets 32, 34 to the upper wall edge of the wardrobe carton, in this preferred embodiment of the invention, each upper wall edge 44 or 46 of the wardrobe carton 52 is provided with a notch.

In most instances, a plurality of spaced apart notches will be provided along each upper wall edge 44 or 46, with each pair of opposed notches being in alignment and facing each other, so that a plurality of spaced apart hanger bars may be mounted in parallel in the wardrobe carton, note the phantom outline 53 of a portion of a hanger bar parallel to the fully detailed hanger bar; this hanger bar 53 would extend to a notch 54. Notches 54, 56 are provided along the upper edge 46 of the wall 50. A similar notch 58 (FIG. 5) is provided along the upper edge 44 of the wall 48. The notches 56 and 58 are aligned opposite to each other along a rectilinear line or axis 59, in order to accommodate the respective brackets or fittings 34 and 32. The rectilinear line or axis 59 extends perpendicular to the two opposed flat planar walls 48 and 50, which are spaced apart and in registration, as shown.

This mounting of the brackets is accomplished in each case by providing, in a preferred embodiment of the invention, an upper bridge for each bracket 34 or 32 which connects together the two transverse flanges of the bracket, as well as a web or panel dependent from the bridge and extending between the flanges, the web or panel fitting into the respective notch. Thus, bracket 34 is provided with an upper bridge 60 extending between the upper edges of the flanges 40 and 42, and the web or panel 62 centrally dependent from the upper bridge 60 and extending between the flanges 40 and 42 and also extending, as shown, into the notch 56. The bracket 32 is provided with an upper bridge 64 extending between the upper edges of the flanges 36, 38, and the web or panel 66 centrally dependent from the bridge 64 and also extending into the notch 58 (FIG. 5). It is to be noted that in this preferred embodiment of the invention, the base or lower terminus 68, 70 of each respective web or panel 62, 66 is curved, and a mating curvature is provided at the base 72 or 74 of each notch 56 or 58, so that each bracket 32 or 34 fits snugly into the respective notch 58 or 56, and is firmly mounted to and on the upper edge 44 or 46 of the respective carton wall 48 or 50. In addition, as shown, each web or panel 62, 66 terminates short of the lower edges of the flanges which are opposite to the respective upper bridge 60 or 64, to further aid in a firm mounting and to prevent wobbling. As shown, each outer flange 42 or 36 extends below the lower terminus of the respective inner flange 40 or 38, to facilitate mounting of the hanger bar and also to provide greater stability and prevent wobbling or dislodging of the hanger bar.

Figure 1:
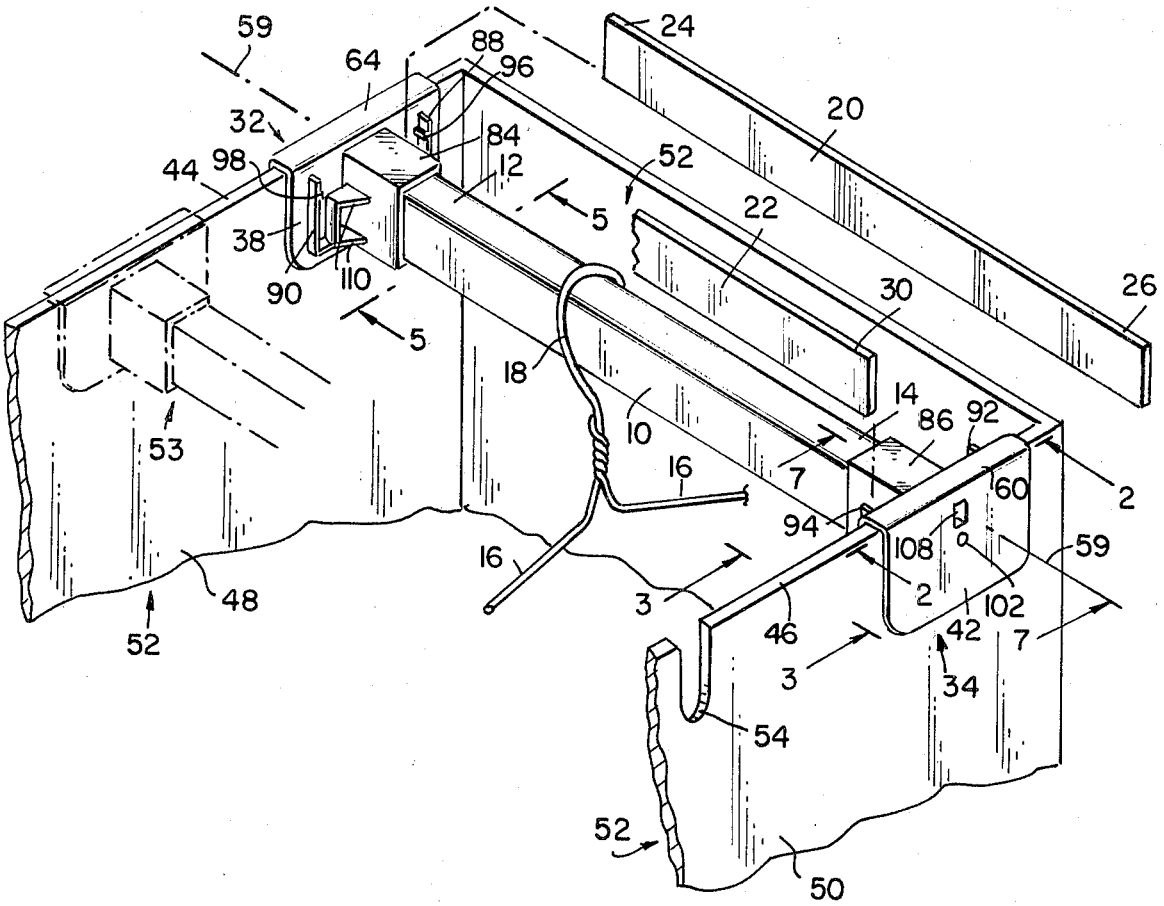
FIG. 1 is a partially exploded perspective view of the present hanger bar structure as mounted to a wardrobe carton.
Figure 2:
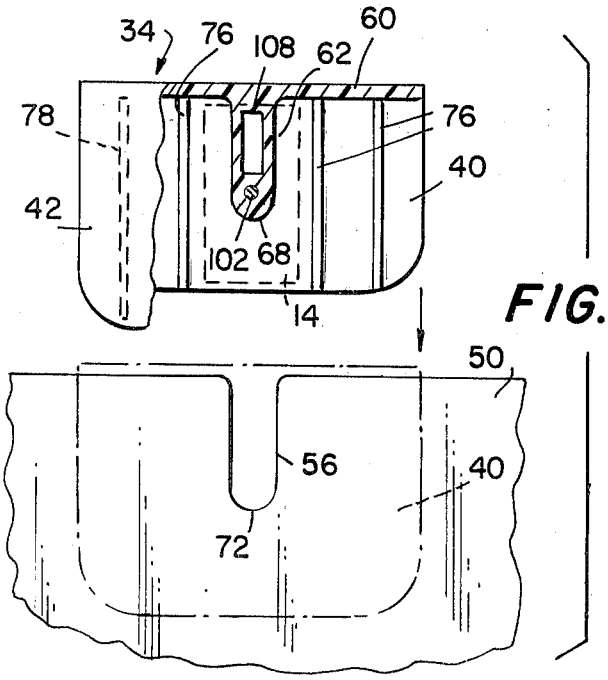
FIG. 2 is an end sectional elevation view taken substantially along the line 2—2 of FIG. 1.

In this embodiment of the invention, the inner surface of each transverse flange is provided with a plurality of parallel stiffening ribs. Thus, as shown, (FIG. 2), flange 40 is provided with ribs 76 and flange 42 is provided with ribs such as 78. See also FIG. 4 where the ribs 76 and 78 also appear, as well as ribs 80 on the inner surface of flange 36 and ribs 82 on the inner surface of flange 38. As shown, these stiffening ribs are parallel and spaced apart, and extend perpendicular to the edge 44 or 46 of a wall of the carton, i.e., the ribs extend vertically and perpendicular to the respective upper bridge 60 or 64.

Figure 3:
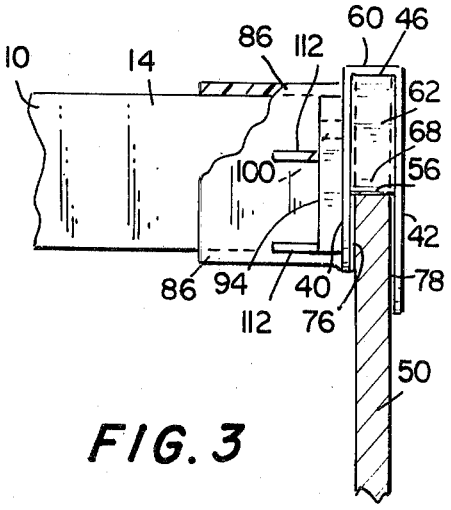
FIG. 3 is an end sectional elevation view taken substantially along the line 3—3 of FIG. 1.

Typically, each end 12, 14 of the main bar 10 fits into a socket 84 or 86 of the respective bracket 32 or 34, which sockets 84 and 86 are rectangular recesses defined by walls which accommodate and mate with the rectangular cross-sectional configuration of the ends 12, 14. In addition, each end 24 or 26 of the auxiliary bar 20, and each end 28 or 30 of the auxiliary bar 22, is fitted into a lateral flanged pocket or slot adjacent the respective socket. Thus, socket 84, as best seen in FIG. 4, is straddled by lateral flanged pockets or slots 88 and 90 which are formed as an integral part of the bracket 32; end 24 of auxiliary bar 20 extends into pocket 88 and end 28 of auxiliary bar 22 extends into pocket 90. Further, socket 86 is straddled by lateral flanged pockets or slots 92 and 94 which are formed as an integral part of the bracket 34; end 26 of auxiliary bar 20 extends into pocket 92 and end 30 of auxiliary bar 22 extends into pocket 94. This cooperation is further seen in FIGS. 5 and 6, which also show in detail another salient feature of the invention, namely, in that each flanged pocket or slot such as 88 or 90 is provided with at least one inner protruding ear, e.g., pocket 88 has inner ear 96 and pocket 90 has inner ear 98, so that the respective end 20 or 22 of the auxiliary bar may be snap-fitted into position (see especially FIG. 6), so that the hanger hook portions such as 18 are firmly held in place. An inner protruding ear 100 for pocket 94 of bracket 34 is seen in FIG. 3. As mentioned supra, typically the brackets 32, 34 will usually be composed of a flexible resilient plastic, to accommodate for the emplacement of all of the hanger bar ends. In addition, as shown, each ear 96, 98 or 100 is disposed adjacent the mouth of the respective pocket or slot 88, 90 or 94.

Figure 7:
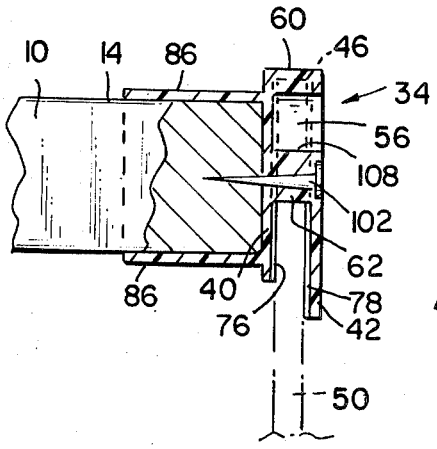
FIG. 7 is a partial sectional elevation view taken substantially along the line 7—7 of FIG. 1.

As shown (FIG. 4), the two generally rectilinear auxiliary bars 20 and 22 are provided laterally on opposite sides of the main bar 10, the two auxiliary bars 20 and 22 straddling the main bar 10 in registration. As best seen in FIG. 6, the main bar 10 is generally rectangular in cross-section, and the auxiliary bars 20, 22 are generally flat, with one flat side facing the main bar 10. Typically, the bars are composed of wood; as best seen in FIG. 7, an attachment means consisting in this case of a nail 102 extends centrally through the bracket 34, and between the bracket 34 and the respective end 14 of the main bar 10, so that the bracket 34 is attached to the main bar 10. Similarly, a nail 104 is provided at the other end 12 of the main bar 10 to attach the bracket 32 to the end 12, see FIG. 5. Alternative attachment means such as a wood screw, a staple or staples, bolting, gluing etc., could be provided in practice instead of or in addition to the nails 102 and 104.

Certain appurtenances such as molding holes 106 and 108 and stiffening and support flanges 110 and 112 will be provided in practice in the respective brackets 32 and 34.

The embodiments of the invention particularly disclosed and described herein above is presented merely as an example of the invention. Other embodiments, forms and modifications of the invention coming within the proper scope and spirit of the appended claims, will of course, readily suggest themselves to those skilled in the art.

It thus will be seen that there are provided a device and article of manufacture which achieve the various objects of the invention and which are well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

What is claimed is:

1. A hanger bar structure for mounting a plurality of garment hangers seriatim and in registration in a wardrobe carton, so that said hangers and associated garments mounted on said hangers are suspended from said hanger bar structure, and so that said hangers are restrained from being dislodged from said hanger bar structure, which comprises;

(a) a generally rectilinear main bar having two opposed ends, said hangers being mountable on said main bar, (b) at least one generally rectilinear auxiliary bar having two opposed ends, said auxiliary bar extending parallel to and laterally spaced from said main bar in registration, so that said auxiliary bar restrains hangers mounted on said main bar against being dislodged, (c) a first bracket, one end of said main bar and one end of said auxiliary bar being receivable in mounting means of said first bracket, (d) a second bracket, the other end of said main bar and the other end of said auxiliary bar being receivable in mounting means of said second bracket, (e) the mounting means of said first and second brackets for mounting said auxiliary bar being disposed laterally to the respective mounting means for said main bar, so that said auxiliary bar is mounted to the side of said main bar, and (f) each of said first and second brackets being provided with two spaced apart terminal transverse flanges in registration, so that the hanger bar structure may be fitted onto the upper edges of two opposed walls of the wardrobe carton.

2. The hanger bar structure of claim 1, in which each upper wall edge of the wardrobe carton is provided with a notch, and each bracket has an upper bridge which connects together the two transverse flanges, and a web or panel dependent from the bridge and extending between the flanges, said web or panel fitting into said notch.

3. The hanger bar structure of claim 2, in which the base of the notch is curved and the terminus of the web or panel is curved.

4. The hanger bar structure of claim 2, in which the web or panel terminates short of the lower edges of the flanges opposite to the upper bridge.

5. The hanger bar structure of claim 1, in which the inner surface of at least one transverse flange is provided with at least one stiffening rib.

6. The hanger bar structure of claim 5, in which the inner surface is provided with a plurality of parallel and spaced apart stiffening ribs.

7. The hanger bar structure of claim 5, in which the stiffening rib extends perpendicular to the edge of a wall of the wardrobe carton.

8. The hanger bar structure of claim 1, in which each end of the main bar fits into a socket in a bracket, and the respective associated end of the auxiliary bar fits into a lateral flanged pocket or slot adjacent said socket.

9. The hanger bar structure of claim 8, in which the flanged pocket or slot is provided with at least one inner protruding ear, so that the end of the auxiliary bar may be snap-fitted into position.

10. The hanger bar structure of claim 9, in which the ear is disposed adjacent the mouth of the pocket or slot.

11. The hanger bar structure of claim 1, in which two generally rectilinear auxiliary bars are provided laterally on opposite sides of the main bar, said two auxiliary bars straddling the main bar in registration.

12. The hanger bar structure of claim 1, in which the main bar is generally rectangular in cross-section, and the auxiliary bar is generally flat.

13. The hanger bar structure of claim 12, in which one flat side of the auxiliary bar faces the main bar.

14. The hanger bar structure of claim 1, in which the bars are composed of wood and the brackets are composed of a flexible resilient plastic.

15. The hanger bar structure of claim 1, in which an attachment means extends between each bracket and the respective end of the main bar.

16. The hanger bar structure of claim 15, in which the attachment means is a central attachment means.

17. A wardrobe carton hanger bar structure comprising;

(a) a generally rectilinear main bar having two opposed ends, a plurality of garment hangers being mountable seriatim and in registration on said main bar and within said wardrobe carton, so that said hangers and associated garments mounted on said hangers are suspended from said hanger bar structure, and within said wardrobe carton, (b) at least one generally rectilinear auxiliary bar having two opposed ends, said auxiliary bar extending parallel to and laterally spaced from said main bar, and in registration with said main bar, so that said auxiliary bar restrains said hangers mounted on said main bar against being dislodged from said hanger bar structure, (c) a first bracket, one end of said main bar and one end of said auxiliary bar being receivable in mounting means of said first bracket, (d) a second bracket, the other end of said main bar and the other end of said auxiliary bar being receivable in mounting means of said second bracket, (e) the mounting means of said first and second brackets for mounting said auxiliary bar each comprising a pocket or slot disposed laterally to the respective mounting means for said main bar, so that said auxiliary bar is mounted to the side of said main bar, and (f) each of said first and second brackets being provided with terminal mounting means so that the hanger bar structure may be fitted onto the upper edges of two opposed walls of the wardrobe carton.

18. The hanger bar structure of claim 17, wherein the pocket or slot includes at least one lateral flange.

19. The hanger bar structure of claim 18, wherein the lateral flange of the pocket or slot is provided with at least one inner protruding ear, so that the end of the auxiliary bar may be snap-fitted into position.

20. The hanger bar structure of claim 19, wherein the ear is disposed adjacent the mouth of the pocket or slot.

21. The hanger bar structure of claim 17, wherein the terminal mounting means includes two spaced apart terminal transverse flanges in registration.

* * * * *